US009556552B2

(12) United States Patent
Park et al.

(10) Patent No.: US 9,556,552 B2
(45) Date of Patent: Jan. 31, 2017

(54) DOOR HINGE APPARATUS AND DRUM TYPE WASHING MACHINE HAVING THE SAME

(71) Applicant: SAMSUNG ELECTRONICS CO., LTD., Suwon-si, Gyeonggi-do (KR)

(72) Inventors: Wan Gi Park, Suwon-si (KR); Chul Yong Cho, Seoul (KR); Seon Ju Lee, Seoul (KR); Ji Hoon Choi, Hwaseong-si (KR); Kab Jin Jun, Gwangju-si (KR); Jong Su Jeon, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/307,726

(22) Filed: Jun. 18, 2014

(65) Prior Publication Data

US 2014/0375188 A1 Dec. 25, 2014

(30) Foreign Application Priority Data

Jun. 19, 2013 (KR) ..... 10-2013-0070383

(51) Int. Cl.
*D06F 39/14* (2006.01)

(52) U.S. Cl.
CPC ..... *D06F 39/14* (2013.01)

(58) Field of Classification Search
CPC ..... D06F 37/10; D06F 37/18; D06F 37/28; D06F 39/14

(Continued)

(56) References Cited

U.S. PATENT DOCUMENTS 4,389,748 A * 6/1983 Grossman ..... E05D 3/12 16/278
2003/0172692 A1 9/2003 Hong et al.

(Continued)

FOREIGN PATENT DOCUMENTS

DE 102009007920 4/2010
EP 0616069 9/1994

(Continued)

OTHER PUBLICATIONS

Espacenet Abstract, Publication No. 102009007920, Published Apr. 29, 2010.

(Continued)

*Primary Examiner* — James O Hansen
(74) *Attorney, Agent, or Firm* — Staas & Halsey LLP

(57) ABSTRACT

A door hinge apparatus having a coupling structure between a door and a cabinet, and a drum-type washing machine having the same. The drum type washing machine includes an inlet formed through the cabinet to allow laundry to be inserted or withdrawn therethrough, a door coupled to the cabinet to open and close the inlet, and a hinge between the door and the cabinet. The hinge includes a cabinet bracket coupled to a front surface of the cabinet, a door bracket coupled to the door, a first moving unit coupled to the door bracket to allow the door to be pivoted with respect to the cabinet, and a second moving unit coupled to the cabinet bracket to allow the door to protrude forward from the cabinet and be substantially parallel and spaced from the cabinet. The door opens the inlet by moving forward by a predetermined distance or more from the cabinet and then pivoting, so that moisture in the drum is removed to some extent before the inlet is opened and the door can open without friction between the door and the cabinet.

6 Claims, 18 Drawing Sheets

(58) Field of Classification Search
USPC ..... 312/228, 326, 329; 68/139
See application file for complete search history.

(56) References Cited

U.S. PATENT DOCUMENTS

| | | | | |
|---|---|---|---|---|
| 2004/0107741 | A1* | 6/2004 | Kim | D06F 37/28 68/24 |
| 2007/0220709 | A1* | 9/2007 | Hill | D06F 39/14 16/347 |

FOREIGN PATENT DOCUMENTS

| | | |
|---|---|---|
| EP | 1333118 | 8/2003 |
| EP | 2107152 | 10/2009 |

OTHER PUBLICATIONS

European Search Report of European Application No. 14171597.9 mailed Oct. 23, 2014.
European Patent Office Decision to Grant dated Jun. 3, 3016 in corresponding European Patent Application No. 14 171 597.9.

* cited by examiner

DOOR HINGE APPARATUS AND DRUM TYPE WASHING MACHINE HAVING THE SAME

CROSS-REFERENCE TO RELATED APPLICATIONS

This application claims the benefit of Korean Patent Application No. 10-2013-0070383, filed on Jun. 19, 2013, in the Korean Intellectual Property Office, the disclosure of which is incorporated herein by reference.

BACKGROUND

1. Field

Embodiments of the present disclosure relate to a door hinge apparatus and a drum type washing machine having the same, and more particularly, to a door hinge apparatus having an improved coupling structure between a door and a cabinet, and a washing machine having the same.

2. Description of the Related Art

In general, a washing machine is an apparatus that washes laundry by rotating a cylindrical drum containing laundry and wash water. The examples of the washing machine include a "front-load" drum type washing machine in which a drum is horizontally disposed and, as the drum rotates forward and backward with respect to a horizontal shaft, laundry is washed by being lifted upward along an inner circumferential surface of a drum and dropping, and a "top-load" vertical shaft washing machine in which a drum provided with a pulsator is vertically disposed in the drum and as the drum rotates forward and backward with respect to a vertical shaft, laundry is washed by water current generated by the pulsator.

The drum type washing machine includes a cabinet forming an external appearance, a cylindrical tub installed in the cabinet and configured to contain wash water, a drum rotatably installed in the tub to wash laundry, a driving motor disposed at a rear side of the tub to rotate the drum, and doors installed at a front side of the cabinet. The cabinet is provided on at least one portion thereof with an inlet communicating with the drum, and a door is configured to open and close the inlet.

After a washing operation is completed, the inlet is opened by pivoting the door. However, a large sized door has difficulty in completely opening. In addition, after a washing operation is completed, moisture in the drum is discharged only when a user opens the door. Accordingly, when laundry remains inside the washing machine for a long period of time, the laundry may smell or be damaged.

SUMMARY

Therefore, it is an aspect of the present disclosure to provide a door hinge apparatus allowing a door to perform a horizontal movement from a cabinet by a predetermined distance or more, and a drum type washing machine having the same.

Additional aspects of the disclosure will be set forth in part in the description which follows and, in part, will be obvious from the description, or may be learned by practice of the disclosure.

In accordance with one aspect of the present disclosure, a drum type washing machine includes a cabinet, an inlet, a door and a hinge apparatus. The cabinet may form an external appearance of the drum type washing machine. The inlet may be formed through the cabinet and allow laundry to be inserted or withdrawn therethrough. The door may be coupled to the cabinet to open and close the inlet. The hinge apparatus connects the door and the cabinet. The hinge apparatus may include a cabinet bracket coupled to a front surface of the cabinet, a door bracket coupled to the door, and a moving unit including a first moving unit coupled to the door bracket and allowing the door to be pivoted with respect to the cabinet, and a second moving unit coupled to the cabinet bracket and allowing the door to move such that the door is protruded forward from the cabinet so as to be spaced from the cabinet.

The second moving unit may include at least one coupling shaft, and according to movement of the at least one coupling shaft, the door may be protruded forward from the front surface of the cabinet.

The second moving unit may include a first coupling shaft and a second coupling shaft, and a plurality of shafts may be inserted into each of the first and second coupling shafts, thereby allowing motion of the first and second shafts.

The second moving unit may include a first bracket and a second bracket to which the first coupling shaft and the second coupling shaft are coupled, respectively.

The first moving unit may be coupled to one side of the second bracket, and pivotedly coupled to the second bracket.

The hinge apparatus may further include a locking step provided at one side of the first moving unit to prevent the door from being pivoted at the same time of being protruded from the cabinet.

The second moving unit may include at least one rail allowing the door to be protruded from the cabinet.

The second moving unit may include a first bracket to which the rail is coupled, and a second bracket coupled to the rail so as to be movable with respect to the first bracket.

The second moving unit may further include a guide rack configured to guide the rail to be coupled to the second bracket.

A stopper protruding toward the second bracket may be provided at one side of the first bracket to restrict movement of the second bracket.

In accordance with another aspect of the present disclosure, a drum type washing machine includes a cabinet, an inlet and a door. The cabinet may form an external appearance of the drum type washing machine. The inlet may be formed through the cabinet and allow laundry to be inserted or withdrawn therethrough. The door may be coupled to the cabinet to open and close the inlet. The door may have a first state of the door being coupled to the cabinet and closing the inlet, a second state of the door being spaced apart from the cabinet by being protruded forward, and a third state of the door being pivoted and opening the inlet.

The drum type washing machine may further include a hinge apparatus to couple the door and the cabinet.

The hinge apparatus may include a moving unit including a first moving unit allowing the door to move from the second state to the third state or move from the third state to the second state, and a second moving unit allowing the door to move from the first state to the second state or move from the second state to the first state.

The second moving unit may include a first coupling shaft and a second coupling shaft, and the first coupling shaft and the second coupling shaft are provided between a first bracket and a second bracket.

The second moving unit may include a first coupling shaft and a second coupling shaft and the first coupling shaft and the second coupling shaft are provided between a first bracket and a second bracket. The first coupling shaft and the second coupling shaft, in the first state, may move toward an inside of the cabinet, and in the second state, move toward an outside of the cabinet.

The second moving unit may include a first bracket and a second bracket slidably coupled to the first bracket. The second bracket, in the first state, may be provided at a rear side of the first bracket, and in the second state, may be slid toward a front side of the first bracket.

At least one rail may be provided at the first bracket, and allow the second bracket to be slid through the rail. At least one stopper provided on the first bracket may restrict movement of the second bracket.

The hinge apparatus may further include a cabinet bracket coupled to a front surface of the cabinet and a door bracket coupled to the door.

In accordance with another aspect of the present disclosure a door hinge apparatus allowing a door configured to open and close an inlet formed through at least one portion of a cabinet to be coupled to the cabinet includes a cabinet bracket, a door bracket and a moving unit. The cabinet bracket may be coupled to the cabinet. The door bracket may be coupled to the door. The moving unit may include a first moving unit allowing the door to move such that the inlet is open, and a second moving unit allowing the door to horizontally move from the cabinet such that the door is spaced apart from the cabinet.

The second moving unit may include a first bracket and a second bracket, and a first coupling shaft and a second coupling shaft that are coupled to a portion between the first bracket and the second bracket. The door may horizontally move from the cabinet according to motion of the first coupling shaft and the second coupling shaft.

The second moving unit may include a first bracket on which at least one rail is provided and a second bracket coupled to the rail so as to be movable with respect to the first bracket.

As apparent from the above, with the door hinge apparatus and the drum type washing machine according to the present application, the door opens the inlet by moving forward by a predetermined distance or more from the cabinet and then pivoting. Accordingly, moisture in the drum can be removed to some extent before the inlet is open by a user. In addition, a large sized door also can be open without friction between the door and the cabinet.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
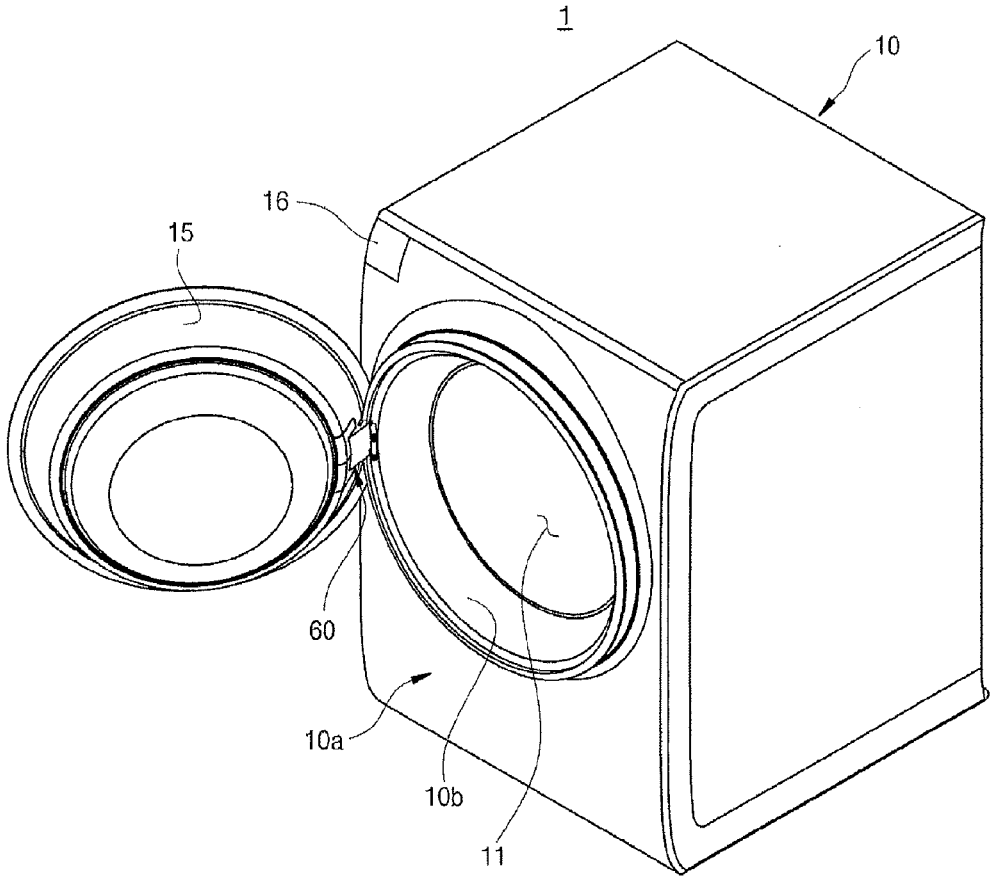
FIG. 1 is a perspective view illustrating an external appearance of a front-load drum type washing machine in accordance with an embodiment of the present disclosure.

Reference will now be made in detail to the embodiments of the present disclosure, examples of which are illustrated in the accompanying drawings, wherein like reference numerals refer to like elements throughout.

Figure 2:
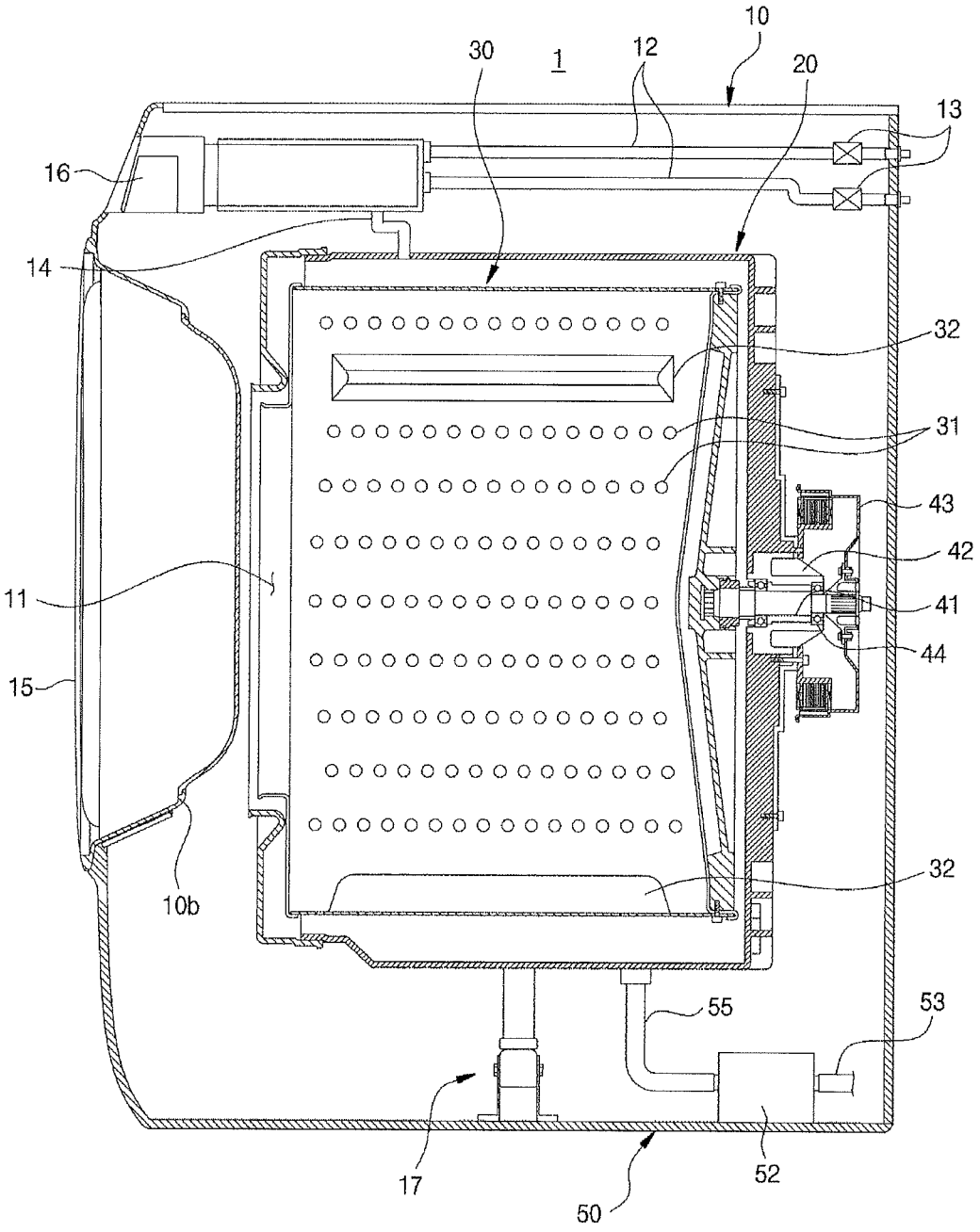
FIG. 2 is a cross section view illustrating the drum type washing machine in accordance with the embodiment of the present disclosure.

FIG. 1 is a perspective view illustrating an external appearance of a drum type washing machine in accordance with an embodiment of the present disclosure, and FIG. 2 is a cross sectional view illustrating the drum type washing machine in accordance with the embodiment shown in FIG. 1.

Referring to FIGS. 1 and 2, the drum type washing machine 1 includes a cabinet 10 forming an external appearance of the drum type washing machine 1, a tub 20 disposed in the cabinet 10, a drum 30 rotatably disposed in the tub 20 and a motor 43 driving the drum 30.

An inlet 11 is formed through a front surface of the cabinet 10 and allows laundry to be inserted or withdrawn therethrough. The inlet 11 is open and closed by a door 15 installed at a front 10*a* of the cabinet 10.

A recess part 10*b* is formed on at least one portion of the cabinet 10 that makes contact with the door 15 when the door 15 closes the inlet 11. The recess part 10*b* is recessed toward an inside of the drum type washing machine 1. The recess part 10*b* may be formed along an edge of the inlet 11. The recess part 10*b* is provided in a shape corresponding to the shape of the door 15. When the door 15 is closed, the door 15 is coupled to the recess part 10*b*, thereby reducing a part of the door 15 exposed from a surface of the cabinet 10.

A water supply pipe 12 is installed at an upper side of the tub 20 to supply water to the tub 20, and has one side thereof connected to a water supply valve 13 and the other side thereof connected to a detergent container 16.

The detergent container 16 is connected to the drum 30 through a water supply pipe 14, and water supplied through the pipe 14 is supplied to the inside of the drum 30 together with detergent via the detergent container 16.

The tub 20 is supported by a damper 17, and the damper 17 connects a bottom surface of inside of the cabinet 10 to an outer surface of the tub 20.

An opening is formed through a front of the drum 30 to allow laundry to be introduced and withdrawn into/from the drum 30 therethrough. A driving shaft 41 is connected to a rear side of the drum 30 to transmit power of the motor 43.

A plurality of through holes 31 through which wash water flows, are formed in a circumference of the drum 30. A plurality of lifters 32 are installed at an inner circumferential surface of the drum 30 so that laundry may be lifted and dropped when the drum 30 is rotated.

A driving shaft 41 is disposed between the drum 30 and the motor 43, one end of the driving shaft 41 is connected to the rear side of the drum 30, and the other end of the driving shaft 41 extends to outside of a rear wall of the drum 30.

When the motor 43 drives the driving shaft 41, the drum 30 connected to the driving shaft 41 is rotated on the driving shaft 41.

A bearing housing 42 is installed at a rear wall of the tub 20 so as to rotatably support the driving shaft 41. The bearing housing 42 may be formed of an aluminum alloy and may be inserted into the rear wall of the tub 20 when the tub 20 is injection molded.

Bearings 44 are installed between the bearing housing 42 and the driving shaft 41 so that the driving shaft 41 may be smoothly rotated.

A drain unit 50 is provided at a lower side of the tub 20 to discharge water in the tub 20 to the outside of the drum type washing machine 1. The drain unit 50 includes a drain pump 52, a connecting hose 55 connecting the tub 20 to the drain pump 52 such that water in the tub 20 is introduced to the drain pump 52, and a drain hose 53 guiding water pumped by the drain pump 52 to the outside of the drum type washing machine 1.

A control panel (not shown) may be provided on the cabinet 10. The control panel may include a display window displaying a status of the drum type washing machine 1 and an operating part allowing a user to control an operation of the drum type washing machine 1.

Figure 3A:
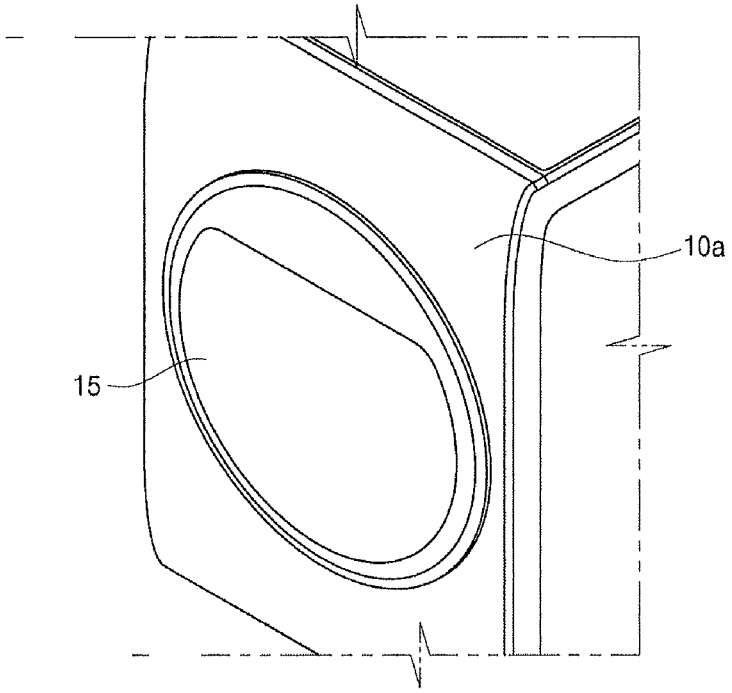
FIGS. 3(*a*)-(*c*) are views sequentially illustrating operation of a door of the drum type washing machine in accordance with an embodiment of the present disclosure.
Figure 3B:
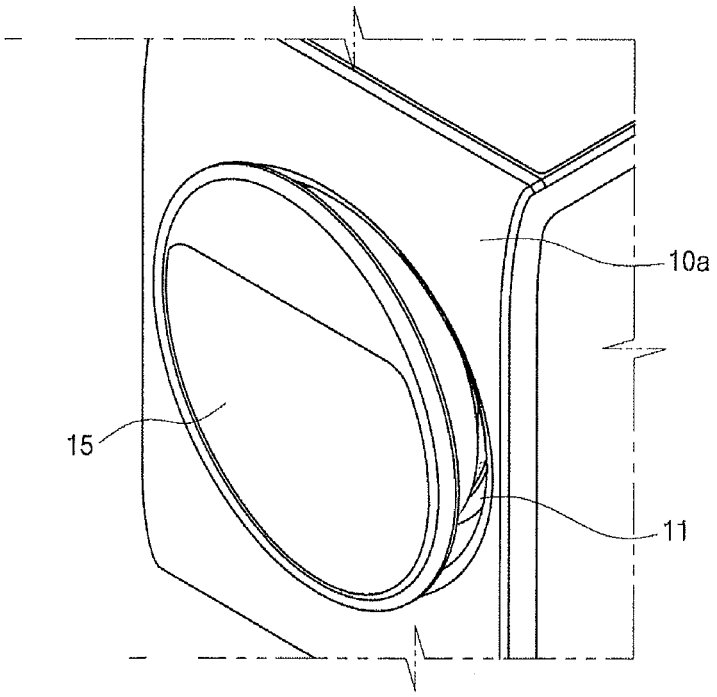
Figure 3C:
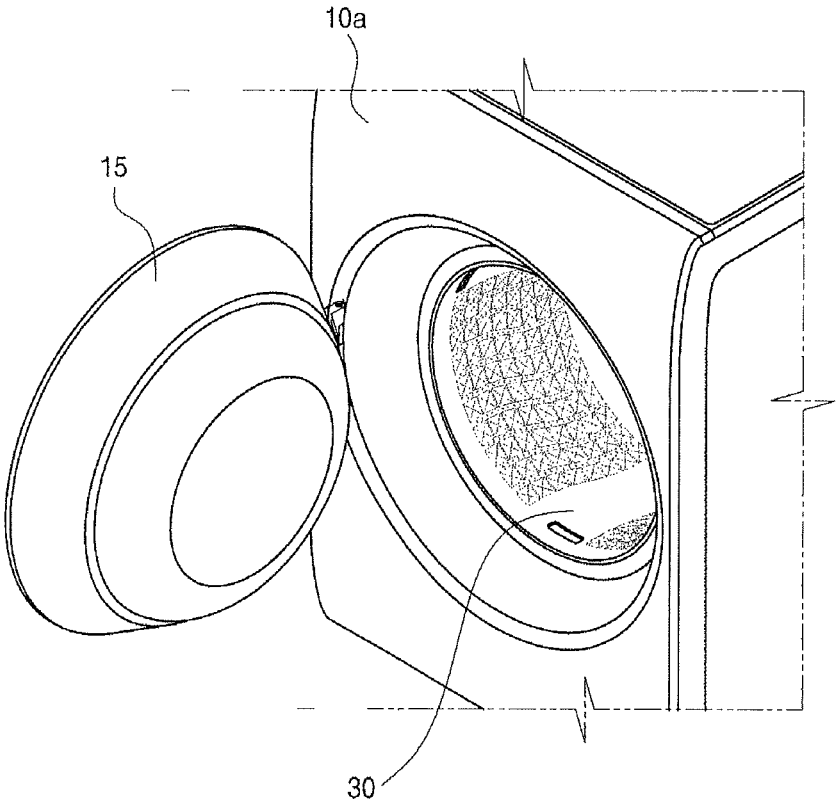

FIGS. 3(*a*)-(*c*) are views illustrating a sequential operation of a door of the drum type washing machine in accordance with an embodiment of the present disclosure.

FIG. 3(*a*) shows a first state in which the door 15 closes the inlet 11, FIG. 3(*b*) shows a second state in which the door 15 is protruded forward of the cabinet 10, and FIG. 3(*c*) shows a third state in which the door 15 opens the inlet 11 by pivoting.

Referring to FIGS. 3(*a*)-(*c*), the door 15 may have the first state of the door 15 being coupled to the cabinet 10 and closed, the second state of the door 15 being spaced apart from the cabinet 10 by horizontally moving from the cabinet 10, and the third state of the door 15 opening the inlet 11 to expose the interior 33 of the drum 30.

The change in the state of the door 15 is achieved by a hinge apparatus 60 that couples the door 15 to the cabinet 10, and this will be described later in detail.

Figure 4A:
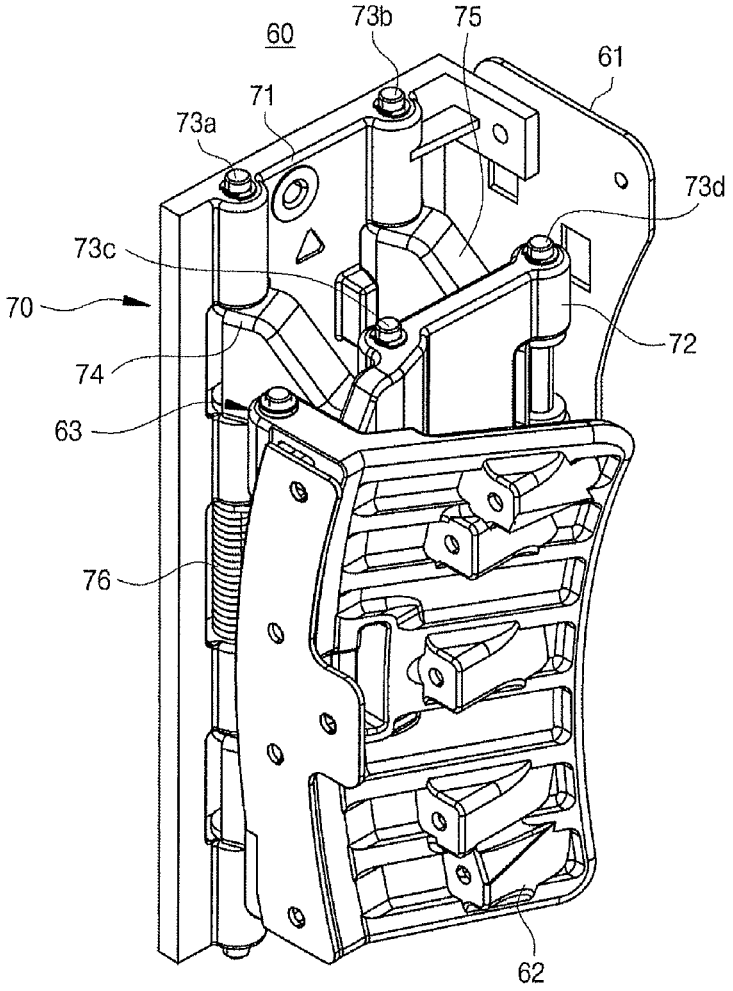
FIGS. 4(*a*)-(*b*) are views illustrating a door hinge apparatus in a first state and a door hinge apparatus in a third state in the drum type washing machine in accordance with an embodiment of the present disclosure.
Figure 4B:
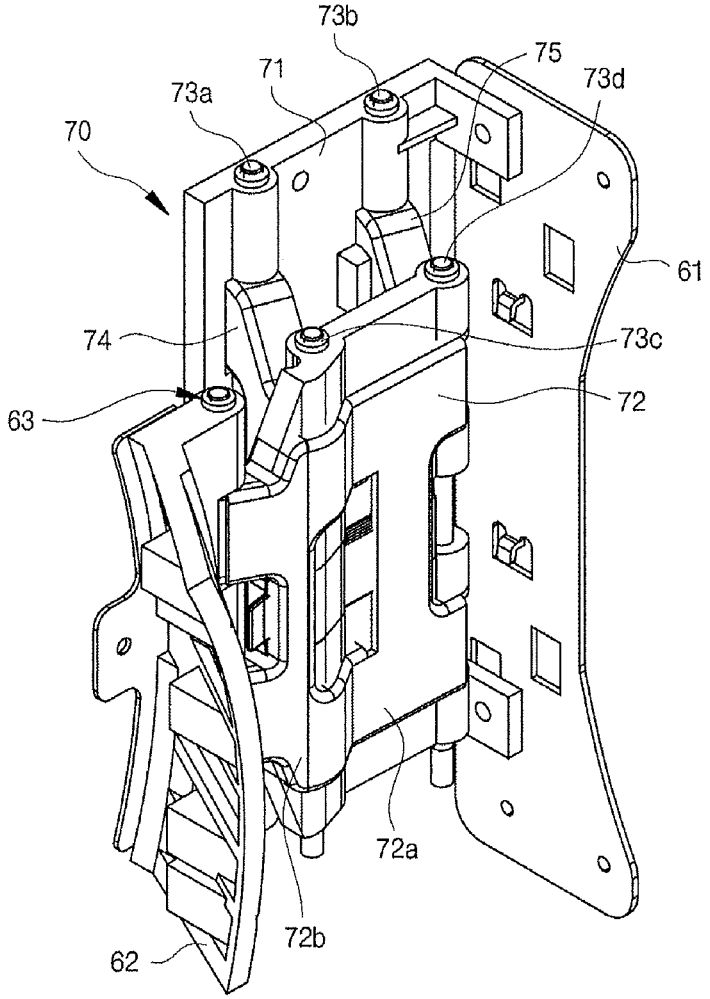
Figure 5:
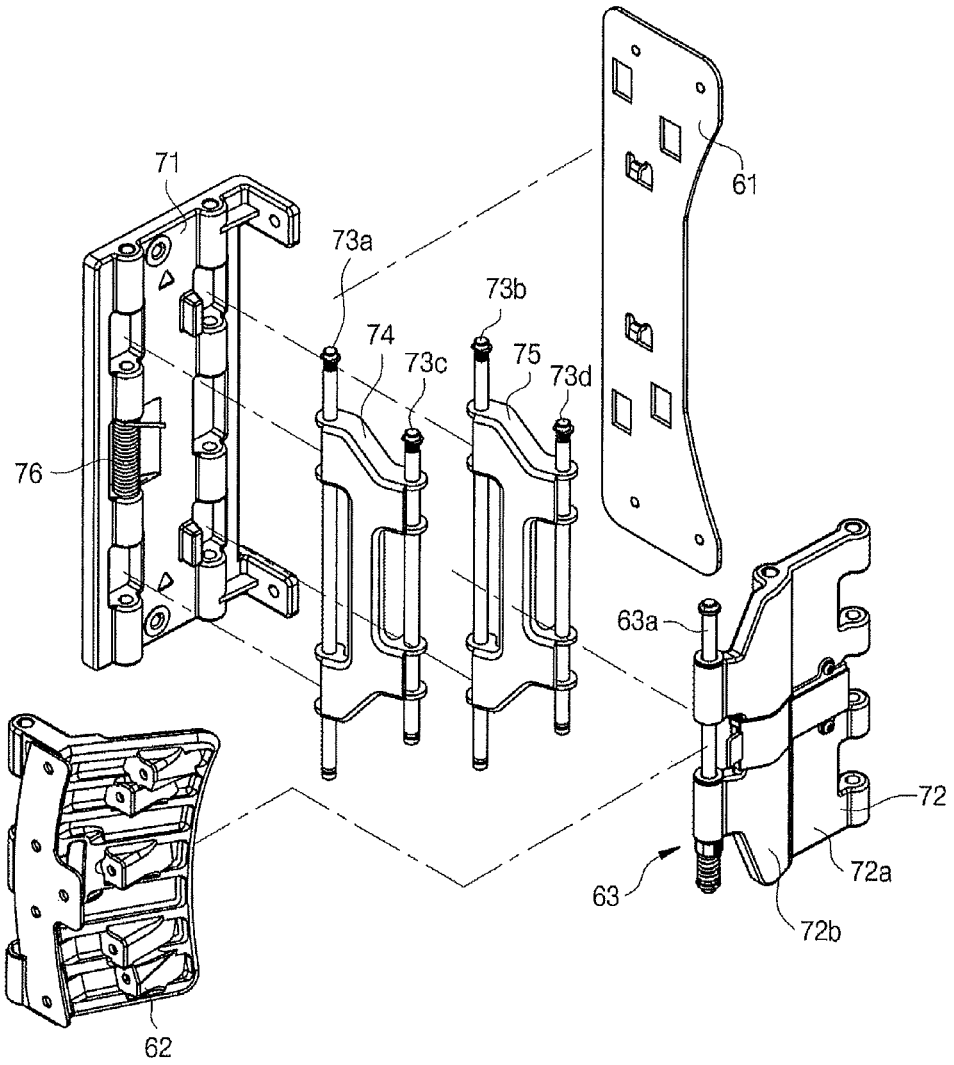
FIG. 5 is an exploded perspective view illustrating the door hinge apparatus in accordance with an embodiment of the present disclosure.

FIGS. 4(*a*) and (*b*) are views illustrating the door hinge apparatus in the first state and in the third state, respectively, in the drum type washing machine in accordance with an embodiment of the present disclosure, and FIG. 5 is an exploded perspective view illustrating the door hinge apparatus in accordance with an embodiment of the present disclosure.

Referring to FIGS. 4(*a*)-(*b*) and 5, the hinge apparatus 60 includes a cabinet bracket 61 coupled to a front surface of the cabinet 10 and a door bracket 62 coupled to the door 15. In addition, the hinge apparatus 60 includes a first moving unit 63 and a second moving unit 70 allowing the door 15 to move. The first moving unit 63 is coupled to the door bracket 62 to pivot the door 15 from the cabinet 10 and the second moving unit 70 is coupled to the cabinet bracket 61 to allow the door 15 to be protruded from the front surface of the cabinet 10.

The first moving unit 63 allows the door 15 to pivot on a shaft.

The second moving unit 70 is provided to horizontally move the door 15 from the cabinet 10, and includes one or more coupling members 74 and 75. According to movement of the coupling members 74 and 75, the door 15 horizontally moves from the cabinet 10. In FIGS. 4(*a*)-(*b*), although the second moving unit 70 includes the two coupling members 74 and 75, the number of coupling members is not limited thereto.

The first coupling member 74 and the second coupling member 75 may be disposed between a first bracket 71 and a second bracket 72. A first shaft 73*a* and a third shaft 73*c* are coupled to the first coupling member 74 for movement, and a second shaft 73*b* and a fourth shaft 73*d* are coupled to the second coupling member 75 for movement. The first moving unit 63 is coupled to one side of the second bracket 72. A fifth shaft 63*a* is coupled to the second bracket 72 such that the first moving unit 63 is pivoted. The fifth shaft 63*a* is coupled to second bracket 72 and the door bracket 62 to allow the pivoting of the door 15.

The second bracket 72 includes a coupling part 72*a* to which the first coupling member 74 and the second coupling member 75 are coupled and a bending part 72*b* to which the fifth shaft 63*a* of the first moving unit 63 is coupled. The fifth shaft 63*a* is coupled to the door bracket 62 to pivot the door 15.

The cabinet bracket 61 is coupled to one side of the first bracket 71 to allow for coupling to the cabinet 10.

An elastic member 76 is coupled to the shaft 73*a* to guide movement of the moving units 63 and 70. According to an embodiment of the present disclosure, the elastic member 76 is coupled to the first shaft 73*a* to guide the movement of the second moving unit 70. In addition, in order to guide the movement of the first moving unit 63, an elastic member may be provided on the fifth shaft 63*a*.

In addition, a locking step (not shown) may be provided between the first moving unit 63 and the second bracket 72 to prevent the door 15 from being unintentionally pivoted from the second state to the third state. That is, in a case in which an external force is not applied, the second state is maintained.

The second bracket 72 moves with respect to the first bracket 71 to allow the door 15 to horizontally move from the cabinet 10. FIG. 4(*a*) represents the hinge apparatus 60 in the first state, and FIG. 4(*b*) represents the hinge apparatus 60 in the third state. As shown in FIGS. 4(*a*)-(*b*), when the door 15 horizontally moves from the cabinet 10 so as to be protruded forward of the cabinet 10, the second bracket 72 moves outward of the cabinet 10, and accordingly, the door bracket 62 coupled to the second bracket 72 is moved outward of the cabinet 10, so that the door 15 performs a forward horizontal movement. The second bracket 72 moves according to the first coupling member 74 and the second coupling member 75. As the first coupling member 74 and the second coupling member 75 move outward of the cabinet 10, the second bracket 72 moves outward of the cabinet 10.

Figure 6A:
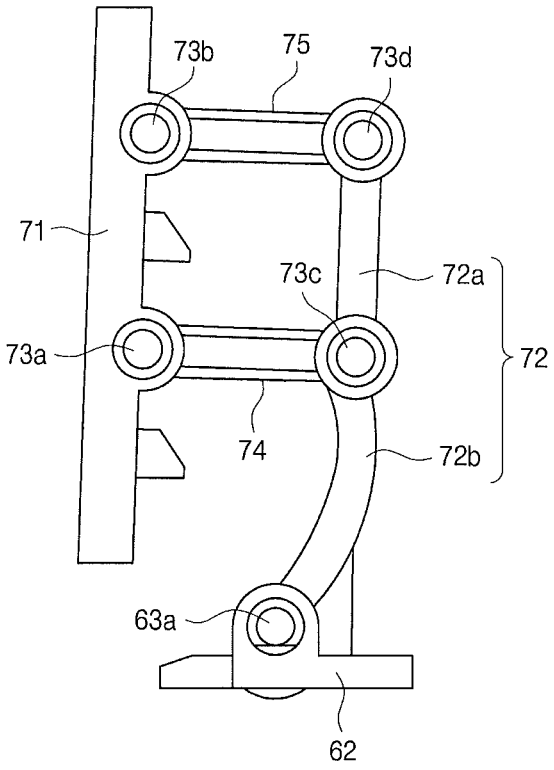
FIGS. 6(*a*)-(*c*) are views illustrating sequential operation of the drum type washing machine in accordance with an embodiment of the present disclosure.
Figure 6B:
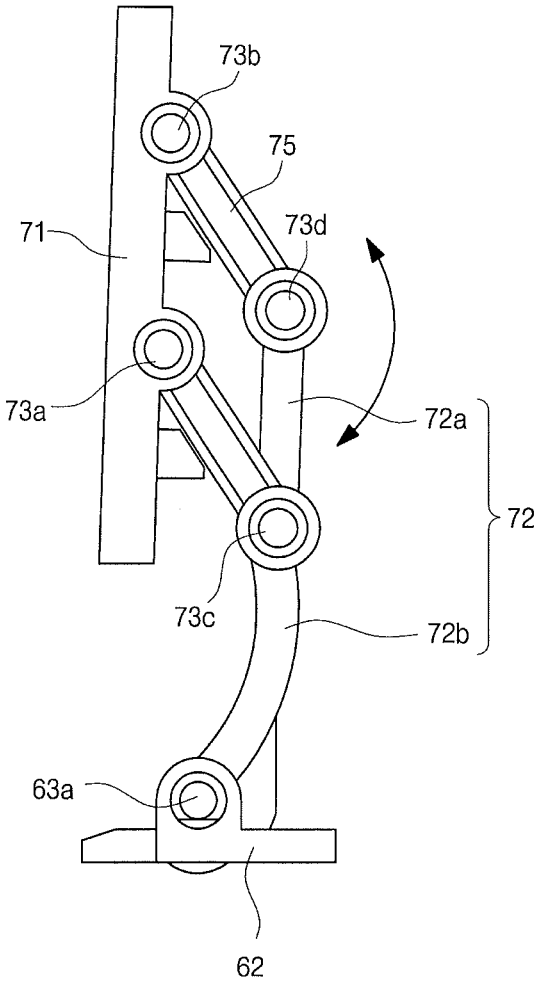
Figure 6C:
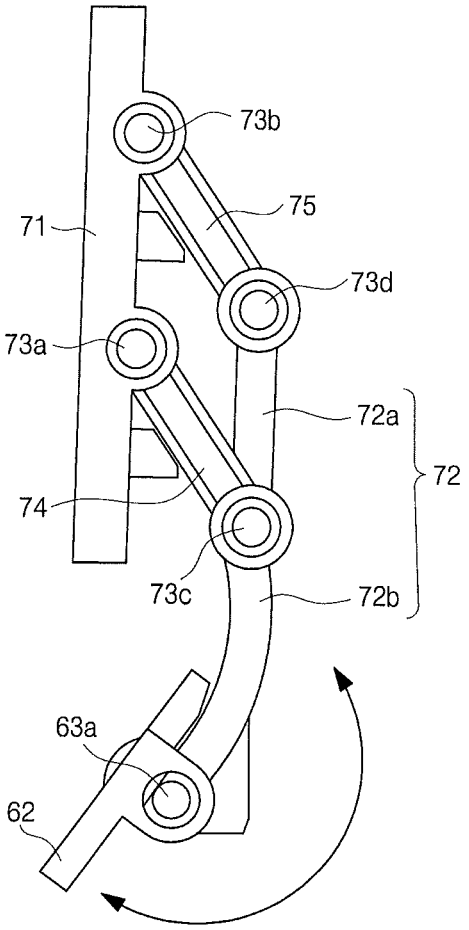

FIGS. 6(*a*)-(*c*) are views illustrating sequential operation of the drum type washing machine in accordance with an embodiment of the present disclosure.

FIG. 6(*a*) illustrates the hinge apparatus 60 in the first state, FIG. 6(*b*) illustrates the hinge apparatus 60 in the second state, and FIG. 6(*c*) illustrates the hinge apparatus 60 in the third state.

Referring to FIGS. 6(*a*)-(*c*), a process of the door 15 sequentially opening the inlet 11 of the drum type washing machine 1 is described. When the door 15 moves from the first state to the second state, the first coupling member 74 and the second coupling member 75 are moved, so that the second bracket 72 is moved. Accordingly, the door bracket 62 coupled to the second bracket 72 is protruded forward. When the door 15 is moved from the second state to the third state, the first moving unit 63 coupling the door bracket 62 to the second bracket 72 is rotated, so that the door bracket 62 is pivoted and thus the door 15 is pivoted to open the inlet 11.

According to an embodiment of the present disclosure, the drum type washing machine 1 has the second state in which the door 15 is spaced apart from the cabinet 10 by a predetermined distance or more than the predetermined distance. Accordingly, moisture remaining after washing laundry is discharged, and then the inlet 11 is open to take spaced out the laundry. In addition, movement of the door 15 from the second state to the third state enables the inlet 11 to be open while preventing the door 15 from making friction with the cabinet 10 even if the size of the door 15 is large.

Figure 7A:
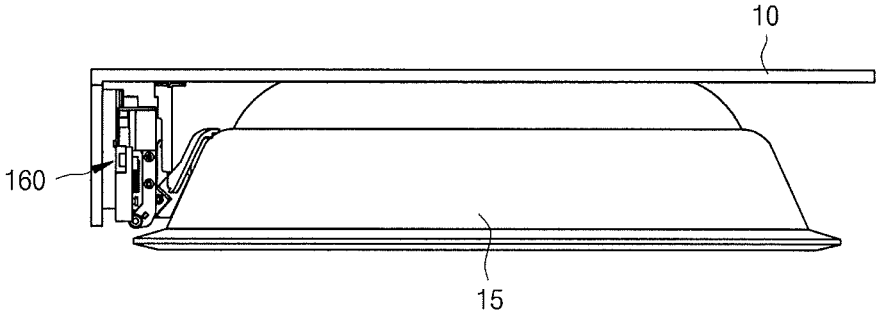
FIGS. 7(*a*)-(*c*) are views sequentially illustrating a state of the door of the drum type washing machine in accordance with an embodiment of the present disclosure being open.
Figure 7B:
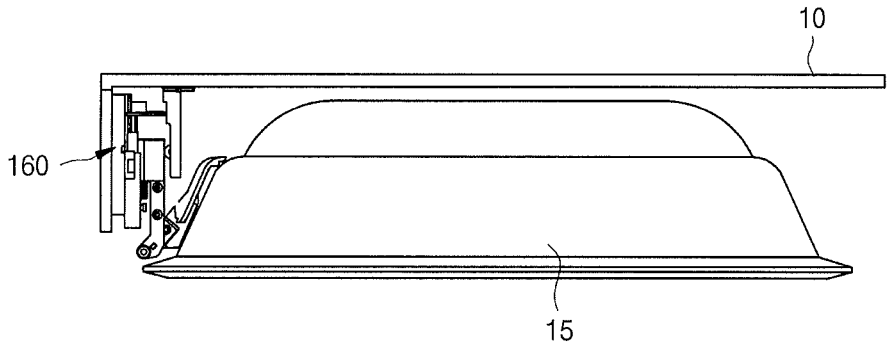
Figure 7C:
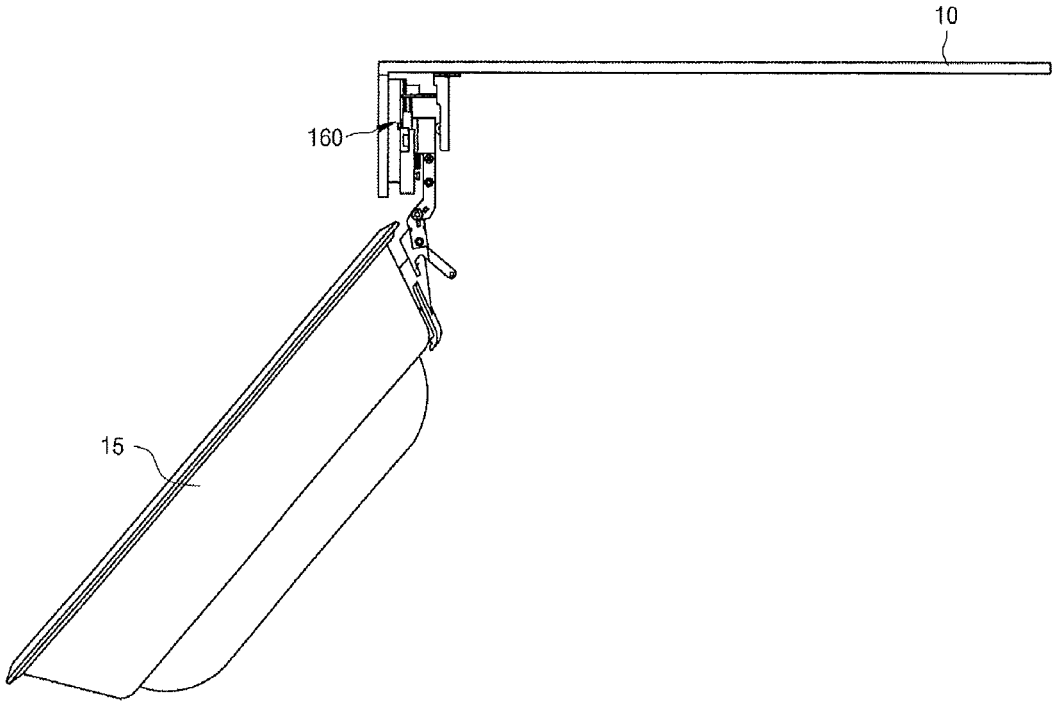

FIGS. 7(*a*)-(*c*) are views sequentially illustrating a state of the door of the drum type washing machine in accordance with an embodiment of the present disclosure being open.

FIGS. 7(*a*) illustrates a state of the inlet 11 closed by the door 15, and FIG. 7(*b*) illustrates a state of the door 15 horizontally moved forward of the cabinet 10, i.e., substantially parallel and spaced from the cabinet, and FIG. 7(*c*) illustrates a state of the inlet 11 opened by pivoting of the door 15. That is, FIG. 7(*a*) illustrates the door 15 in the first state, FIG. 7(*b*) illustrates the door 15 in the second state, and FIG. 7(*c*) illustrates the door 15 in the third state. When the door 15 is moved from the first state to the second state, a part of the hinge apparatus 160 is moved forward of the cabinet 10. When the door 15 is moved from the second state to the third state, a part of the hinge apparatus 16 is pivoted. This will be described later.

Figure 8:
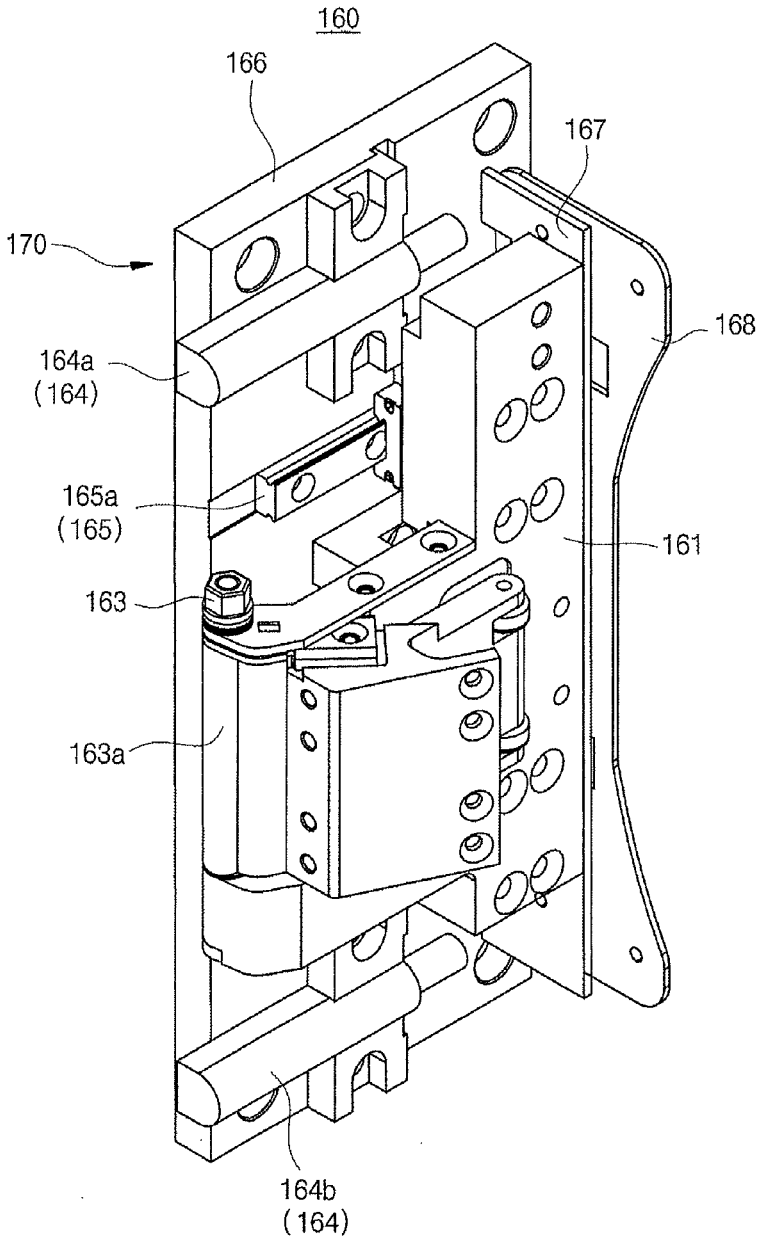
FIG. 8 is a view illustrating a door hinge apparatus in accordance with an alternate embodiment of the present disclosure.
Figure 9A:
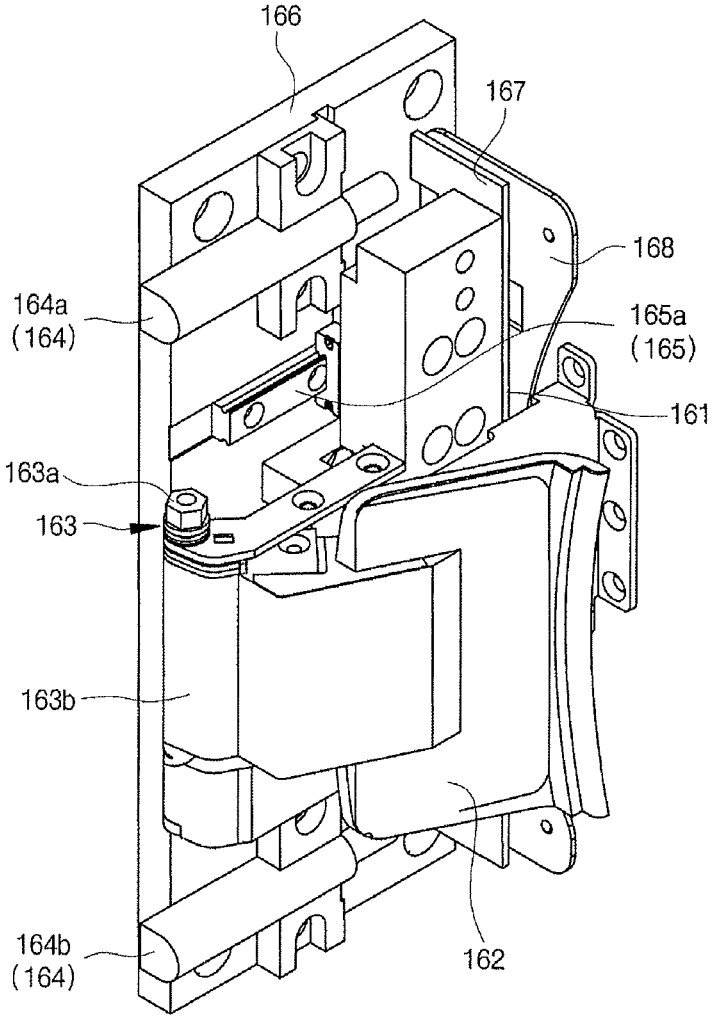
FIGS. 9(*a*)-(*b*) are views illustrating the door hinge apparatus in a first state and the door hinge apparatus in a third state in the drum type washing machine in accordance with the alternate embodiment of the present disclosure.
Figure 9B:
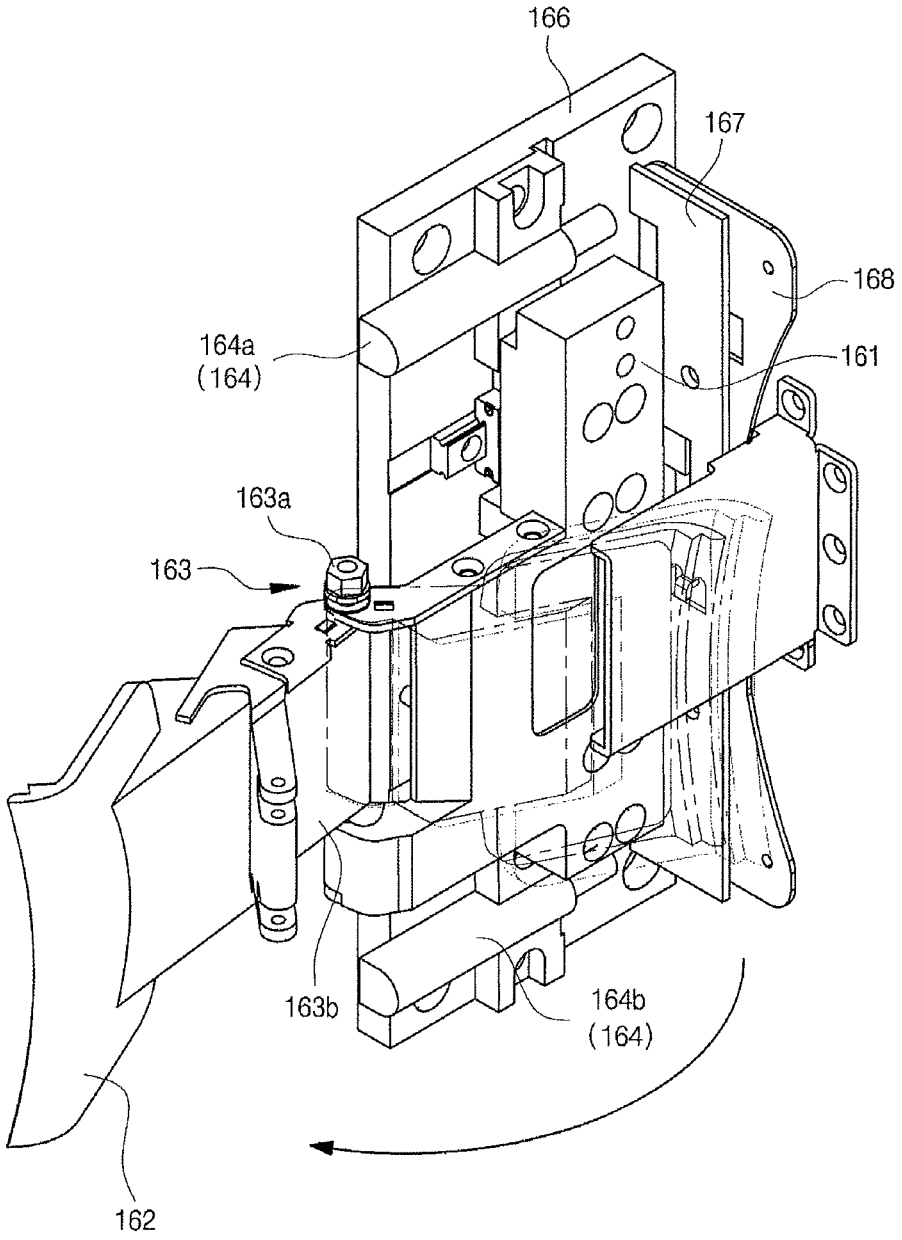
Figure 10:
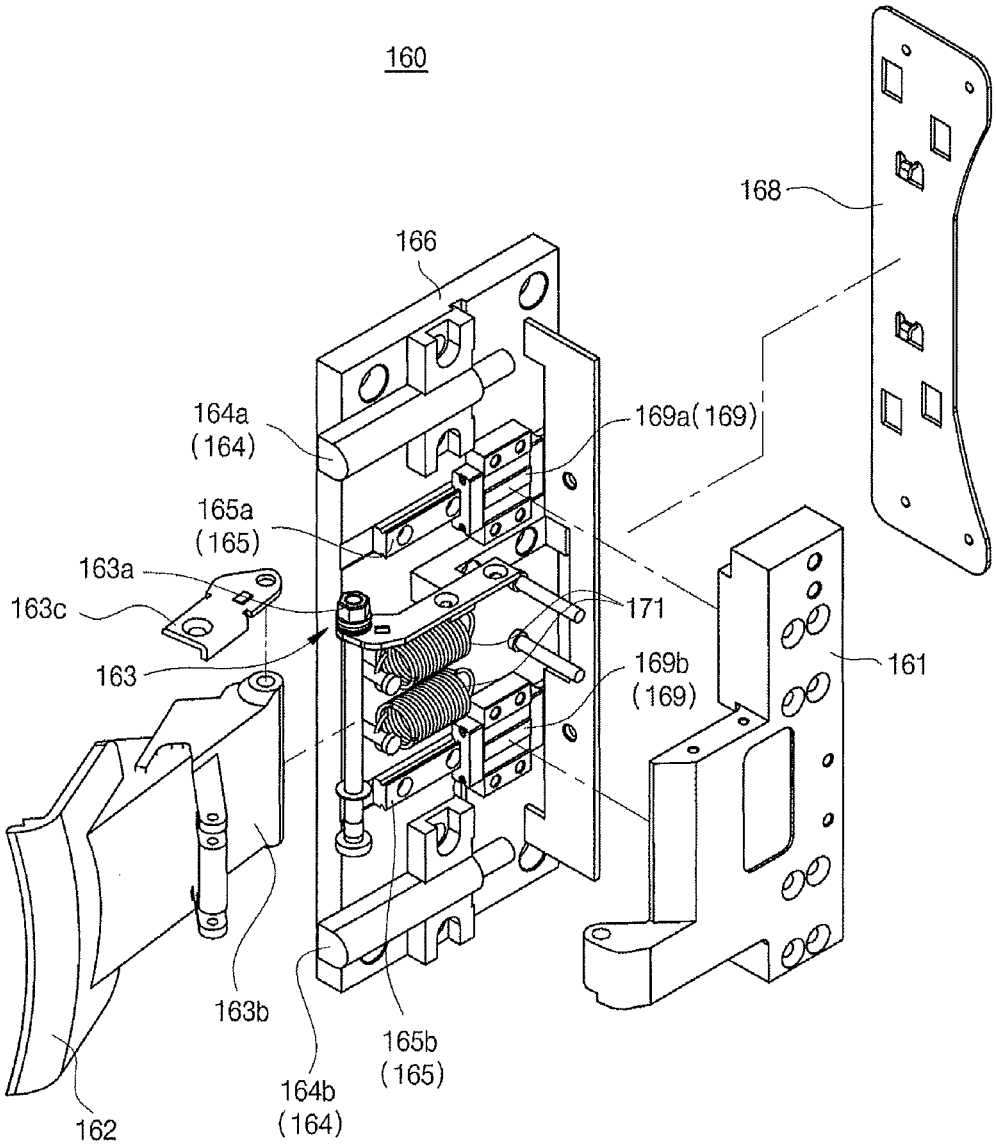
FIG. 10 is an exploded perspective view illustrating the door hinge apparatus in accordance with an embodiment of the present disclosure.

FIG. 8 is a view illustrating the door hinge apparatus in accordance with an alternate embodiment of the present disclosure, FIGS. 9(*a*)-(*b*) are views illustrating the door hinge apparatus in the first state and the door hinge apparatus in the third state in the drum type washing machine in accordance with this alternate embodiment of the present disclosure, and FIG. 10 is an exploded perspective view illustrating the door hinge apparatus in accordance with this alternate embodiment of the present disclosure.

Referring to FIGS. 8 to 10, a second moving unit 170 includes at least one rail 165 allowing the door 15 to be protruded from the cabinet 11. That is, the rail 165 is coupled to a first bracket 166, and a second bracket 161 is coupled to the rail 165. The second bracket 161 is slidably coupled to the first bracket 166. In addition, a guide rack 169 is fittedly coupled to the rail 165 so that the second bracket 161 can be guided with respect to the first bracket 166 by the rail 165. A cabinet bracket 168 is also provided, as with the embodiment described above.

In accordance with an embodiment of the present disclosure, the rail 165 is provided with a first rail 165*a* and a second rail 165*b*, and accordingly, the guide rack 169 is provided with a first guide rack 169*a* and a second guide rack 169*b*. The second bracket 161 is coupled to the first guide racket 169*a* and the second guide rack 169*b* so that the second bracket 161 can move forward and backward relative to the first bracket 166.

In addition, shock absorbing members 164 and 171 are provided around the rail 165 to mitigate shock generated according to the movement of the second bracket 161. The shock absorbing members 164 and 171 may include a damper 164 and an elastic member 171. In accordance with an embodiment of the present disclosure, a first damper 164*a* is provided at an upper side of the first rail 165*a*, and a second damper 164*b* is provided at a lower side of the second rail 165*b*, so that shock and noise generated due to the movement of the second bracket 161 are mitigated. In addition, at least one elastic member 171 is provided between the first rail 165*a* and the second rail 165*b* to mitigate the shock. As shown in the drawings, the elastic member 171 is provided in a total of two, but the number of the elastic members is not limited thereto. In addition, the elastic member 171 is coupled to the second bracket 161 so as to guide the second bracket 161 being moved forward of the first bracket 166 due to an elastic force.

In addition, the damper 164 prevents the second bracket 161 from being moved by a predetermined distance or more, thereby preventing the second bracket 161 from being excessively moved with respect to the first bracket 166 so that the door 15 is prevented from excessively being protruded forward of the cabinet 11.

In addition, in order to prevent the second bracket 161 from being moved by a predetermined distance or more, the first bracket 166 is provided at one side thereof with a stopper 167 that protrudes from the first bracket 166 toward the second bracket 161. In accordance with an embodiment of the present disclosure, the stopper 167 is provided at a rear side of the first bracket 166 to prevent the second bracket 161 from being excessively moved backward.

A first moving unit 163 is coupled to one side of the second moving unit 170. The first moving unit 163 has a shaft 163*a* serving as an axis of rotation, and pivots to allow the door 15 to open and close the inlet 11. The shaft 163*a* is coupled to a coupling part 163*b* of a door bracket 162. The door bracket 162 is coupled to one side of the first moving unit 163. In addition, a locking step 163*c* is coupled between the first moving unit 163 and the door bracket 162 to prevent the door 15 from being unintentionally pivoted from the second state to the third state. Accordingly, after the washing operation is completed, a user may apply an external force such that the door 15 enters the third state.

After the washing operation is completed, the door 15 may be automatically opened. However, unless a user applies an external force, the locking step 163*c* enables the door 15 to maintain the second state. In addition, when the door 15 is closed, a user may move the door 15 from the third state to the second state, and then manually move the door 15 from the second state to the first state. Alternatively, a user may move the door 15 from the third state to the second state, and then allows the door 15 to be automatically moved into the first state. In a state of the door 15 in the first state, a door locking apparatus (not shown) operates to lock the door 15, thereby preventing the door 15 from being open.

As apparent from the above, with the door hinge apparatus and the drum type washing machine according to the present application, the door opens the inlet by moving forward by a predetermined distance or more from the cabinet and then pivoting. Accordingly, moisture in the drum can be removed to some extent before the inlet is open by a user. In addition, a large sized door also can be open without friction between the door and the cabinet.

Although several embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drum type washing machine comprising:

a cabinet having a front surface;

an inlet formed in the front surface of the cabinet to insert or withdraw laundry;

a door coupled to the a front of the cabinet to open and close the inlet; and a hinge connected between the door and the cabinet and including— a first bracket on the front of the cabinet;

a second bracket on the door;

a first moving device pivotally coupled to the second bracket and allowing the door to be opened and closed with respect to the cabinet, and a second moving device pivotally coupled to the first bracket and allowing the door to be protruded forward from the cabinet, wherein the door is movable relative to the inlet from a first state of fully closing the inlet, to a second state of partially opening the inlet by protruding forward from and being spaced from the inlet and being substantially parallel to the front surface of the cabinet by movement of the second moving device to allow moisture to escape the inlet, and to a third state of being fully open by being pivoted from the second state via movement of the first moving device relative to the second moving device to allow the insertion or withdrawal of laundry, wherein the second moving device includes at least one coupling member, and wherein the at least one coupling member includes a first coupling member and a second coupling member, and a first shaft is inserted into each of the first and second coupling members, and a second shaft is inserted into each of the first and second coupling members.

2. The drum type washing machine of claim 1, wherein both the first coupling member and the second coupling member are coupled between the first bracket and the first moving device.

3. The drum type washing machine of claim 2, wherein the first moving device is coupled to one side of the second bracket.

4. A drum type washing machine comprising:

a cabinet having a front surface;

an inlet formed in the front surface of the cabinet to insert or withdraw laundry;

a door coupled to the cabinet to open and close the inlet; and a hinge having a first moving device pivotably connected to the door and a second moving device pivotably connected between the first moving device and the cabinet;

wherein the door is movable relative to the inlet from a first state of fully closing the inlet, to a second state of partially opening the inlet by protruding forward from and being spaced from the inlet and being substantially parallel to the front surface of the cabinet by movement of the second moving device to allow moisture to escape the inlet, and a third state of being fully open by being pivoted from the second state via movement of the first moving unit relative to the second moving unit to allow the insertion or withdrawal of the laundry, wherein the second moving device includes a first coupling member and a second coupling member, and the first coupling member and the second coupling member are provided between a first bracket connected to the cabinet and the first moving device, and wherein the first coupling member and the second coupling member, in the first state, pivot toward an inside of the cabinet, and in the second state, move toward an outside of the cabinet.

5. The drum type washing machine of claim 4, wherein the hinge further includes a cabinet bracket coupled to a front surface of the cabinet and a door bracket coupled to the door.

6. A door hinge allowing a door to open and close an inlet formed in a cabinet and being coupled to the cabinet, the door hinge comprising:

a hinge connected between the door and the cabinet, including— a first moving device allowing the door to swing open relative to the inlet of the cabinet;

a second moving device pivotally connected between the first moving device and the door and allowing the door to move outwardly from the inlet of the cabinet, a first bracket attached to the cabinet; and a first coupling member and a second coupling member coupled between the first bracket and the first moving device, wherein the door is movable relative to the inlet from a first state of fully closing the inlet, to a second state of partially opening the inlet by protruding forward from and being spaced from the inlet and being substantially parallel to a front surface of the cabinet by movement of the second moving device to allow moisture to escape the inlet, and to a third state of being fully open by being pivoted from the second state via movement of the first moving device relative to the second moving device to allow insertion or withdrawal of laundry, and wherein the door horizontally moves away from the cabinet, when the first coupling member and the second coupling member pivot in a direction away from an interior of the cabinet and toward the door.

* * * * *